US006685196B1

(12) United States Patent
Baerveldt

(10) Patent No.: US 6,685,196 B1
(45) Date of Patent: Feb. 3, 2004

(54) HYDROPHILIC JOINT SEAL

(76) Inventor: Konrad Baerveldt, 180 Highbourne Road, Toronto, Ontario (CA), M5P 2J7

( * ) Notice: Subject to any disclaimer, the term of this patent is extended or adjusted under 35 U.S.C. 154(b) by 144 days.

(21) Appl. No.: 09/652,803

(22) Filed: Aug. 31, 2000

(30) Foreign Application Priority Data

Jan. 18, 2000 (CA) ..... 2296230

(51) Int. Cl.[7] ..... F16J 15/10

(52) U.S. Cl. ..... 277/650; 277/628; 277/652; 277/654; 52/396.04

(58) Field of Search ..... 52/396.04; 277/590, 277/650, 652, 654, 628

(56) References Cited

U.S. PATENT DOCUMENTS 4,299,921 A * 11/1981 Youssef
4,767,655 A * 8/1988 Tschudin-Mahrer ..... 428/57
4,839,223 A * 6/1989 Tschudin-Mahrer ..... 428/317.1
4,977,018 A * 12/1990 Irrgeher et al. ..... 428/314.4
5,044,835 A 9/1991 Fukushima et al.
5,130,176 A * 7/1992 Baerveldt ..... 426/192
5,935,695 A 8/1999 Baerveldt
5,988,648 A * 11/1999 Schmid
6,320,093 B1 * 11/2001 Augustine et al.
6,324,703 B1 * 12/2001 Chen
6,479,622 B1 * 11/2002 Gross et al. ..... 528/376

OTHER PUBLICATIONS

Search report for corresponding European application (3 pages).

* cited by examiner

*Primary Examiner*—Anthony Knight
*Assistant Examiner*—E Peavey
(74) *Attorney, Agent, or Firm*—Randall J. Knuth

(57) ABSTRACT

A joint seal for use in joints that may be exposed to water comprises at least one layer of a compressible impregnated open cell foam. On at least a portion of the surface of the compressible foam there is positioned a hydrophilic material.

6 Claims, 2 Drawing Sheets

HYDROPHILIC JOINT SEAL

FIELD OF THE INVENTION

The present invention relates to the field of joint sealants. In particular, the present invention provides a novel compressible sealant with hydrophilic properties.

BACKGROUND OF THE INVENTION

The principle function of a joint sealant is to prevent the entry of water into the space between adjacent structural elements. The structural elements may be pairs of a building, roadway, parking deck, bridge, or other engineering structure. They may be fixed relative to one another, or fairly mobile relative to one another. Waterproofing a joint between two relatively immobile elements is fairly straight forward, because fairly inflexible material can be utilized. However, even then, thermal expansion and contraction of the joint must be considered. Mobile joints, like expansion joints in bridge surfaces present greater problems, because they are expected to flex in three dimensions, and joints exposed to standing water, such as those found in drainage systems, or canals, must exhibit enhanced water resistance, as well as flexibility in many applications.

Flexible, water resistant joint sealants have taken several forms. For instance, in Emseal Corporation's COLORSEAL™ and BACKERSEAL™ products, sealants composed of alternate layers of compressible and incompressible foam are utilized. Such sealants provide the flexibility inherent in compressible, usually impregnated forms and the moisture resistance of incompressible, closed cell foams. A limitation of such products is that under severe moisture conditions, or when exposed to standing water, moisture can penetrate between the foam layers.

Corresponding reference characters indicate corresponding parts throughout the several views. The exemplification set out herein illustrates one preferred embodiment of the invention, in one form, and such exemplification is not to be construed as limiting the scope of the invention in any manner.

On the other hand, hydrophilic sealants, that expand to form a water tight plug when exposed to moisture, are also available. The drawback of these is that they are relatively inflexible, so generally have been found to be inappropriate for use in mobile joints.

SUMMARY OF THE INVENTION

In a broad aspect, the present invention relates to a joint seal for use in joints that may be exposed to water comprising at least one layer of a compressible impregnated open cell foam, on at least a portion of the surface of which is positioned a hydrophilic material.

The object of the present invention is to provide a joint sealant that combines the best properties of compressible foam and hydrophilic sealants. The sealant of the present invention is flexible enough to be used in mobile joints, and upon exposure to water will expand to firmly seal a joint.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any matter.

DETAILED DESCRIPTION OF THE INVENTION

Figure 1:
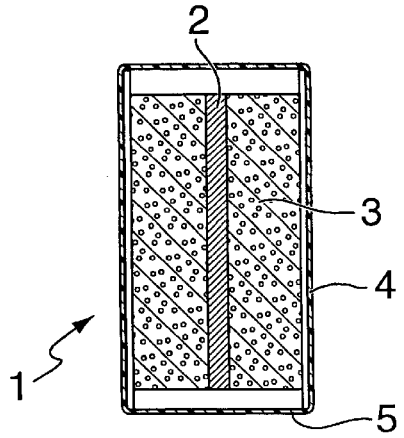
FIG. 1 is a cross-sectional view of a joint seal according to a first embodiment of the present invention.
Figure 2:
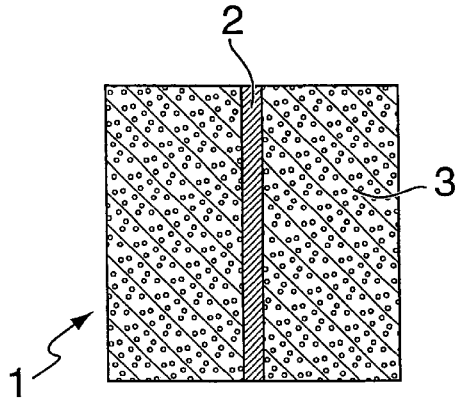
FIG. 2 is a cross-sectional view of the seal of FIG. 1.

Referring now to FIGS. 1–4, a joint seal 1 of the present invention comprises, in its basic form, a layer of hydrophilic material 2 sandwiched between two layers of compressible open celled impregnated foam 3. Open celled impregnated foam 3, such as that sold under the trade marks GREYFLEX, 25V or 20H, by Emseal Corporation is suitable for use as layer 3. Layer 3, on its outer surfaces, may also have an adhesive applied thereto, to promote good adhesion to a joint surface, and to the surface of hydrophilic layer 1.

As can be seen in FIG. 1, the seal is packaged in a precompressed format, preferably as shown with the foam layers compressed and held in compression by stiff boards 4 that are held in place by a layer 5 of shrink-wrap or tape. It may also be packaged in recompressed formation reels. In its uncompressed state, a typical seal will resemble that shown in FIG. 2, where it can be seen that the impregnated open cell foam will expand to three or four times its compressed volume when released from compression. This property permits a tight seal to be achieved against the side surfaces of a joint, as shown in FIGS. 3 and 4.

Figure 4:
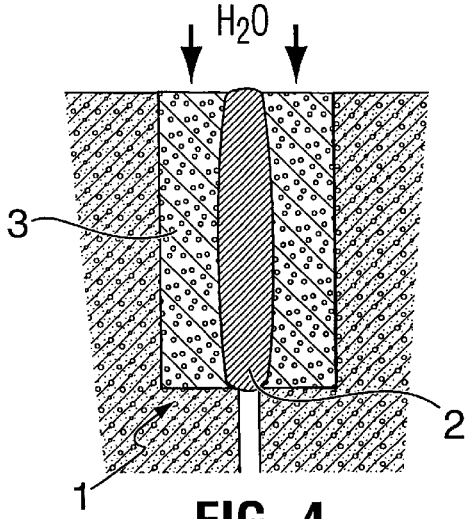
FIG. 4 is a cross-sectional view of the seal installation of FIG. 3, showing the hydrophilic portion thereof expanded.

In FIG. 4, a seal is shown installed in a joint, which is a squared channel formed in the upper surfaces of adjacent elements such as concrete slabs. The seal is installed in a clean joint, by being inserted therein with the upper edge of the seal preferably flush with the upper edge of the joint. The seal is unwrapped from its packaging, and pressed against one side surface of the joint at the correct height, where it will stick, due to the adhesive action of the adhesive on the exterior surface of foam layer 3, or by means of an adhesive reapplied to both faces of the joint or layer 3.

Figure 3:
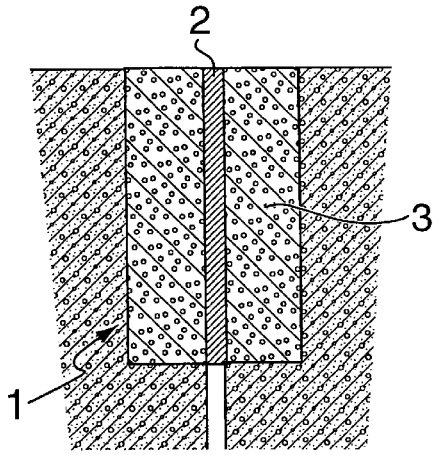
FIG. 3 is a cross-sectional view of the seal of FIG. 1, installed in a joint.

When the compressed foam layers 3 expand, the seal will fill the joint, as shown in FIG. 3.

If the joint is exposed to a large amount of water, as shown in FIG. 4, the hydrophilic layer 2 will swell, squeezing the foam layers 3 tight against the sides of the joint, and rendering the joint water tight, even against significant pressures.

It is important to note that the hydrophilic layer alone, in the absence of the compressible foam layers provided by the present invention, is of limited utility as a joint seal, as it will tend to extrude from a joint if over swollen, as it is unconfined in a joint.

Suitable hydrophilic compounds are sold under the trade mark ADEKA ULTRA SEAL by Adeka Ultra Seal U.S.A., in sheets, tapes, strips, pastes, gels and liquids. Other appropriate hydrophilic compounds such as bentonite clay, sodium bentonite will be a matter of choice to one skilled in the art.

Figure 5:
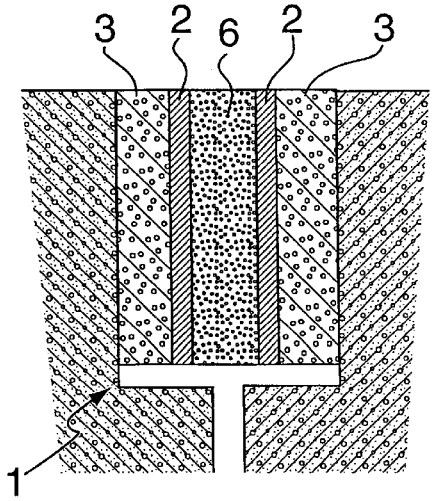
FIGS. 5, 6, 7 and 8 are views similar to FIG. 3, of alternate embodiments of the joint seal of the present invention, installed in a joint.

Referring now to FIG. 5, an alternative embodiment of the present invention, especially useful for application in wide joints is illustrated. The joint seal 1 shown in FIG. 5 comprises outer layers of compressible adhesive impregnated foam 3 surrounding inner layers of hydrophilic material 2, with a core of non-compressible closed cell foam 6. The core of non-compressible foam acts as a fairly inflexible, impervious and inexpensive seal, permitting the use of smaller amounts of the flexible expanding layers which are more expensive, and less impervious to water. It will be understood that more than one layer of non-compressible foam may be used, interleaved with compressible foam and/or hydrophilic layers. Moreover, only one layer 2 of hydrophilic material may be provided, but the use of two layers improves the symmetry of the seal. The relative positions of the hydrophilic layers 2 and the foam layers 3 are interchangeable.

Figure 7:
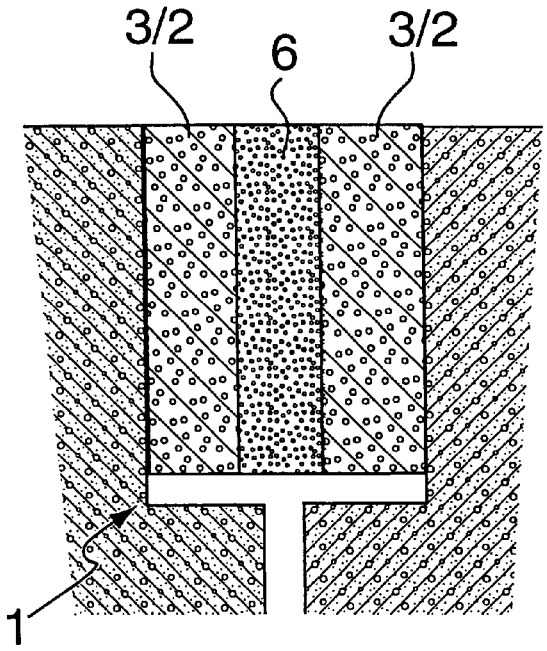

FIG. 7 illustrates an embodiment of the present invention using an incompressible closed cell core 6, sandwiched by two layers of compressible foam 3, partially impregnated with hydrophilic material 2, by spraying one or more surfaces thereof, or applying paste to the surfaces thereof. Other methods of impregnating the foam 3 with the hydrophilic material 2 will be obvious to one skilled in the art. The benefit provided by the FIG. 7 embodiment is that when the hydrophilic material swells, it will make an effective waterstop, but does not tend to bulge out of the joint. The embodiment of FIG. 7 will find application in joints such as vertical joints between concrete panels in a curtain wall.

Figure 6:
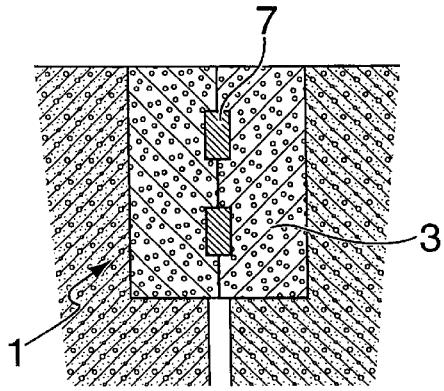
Figure 8:
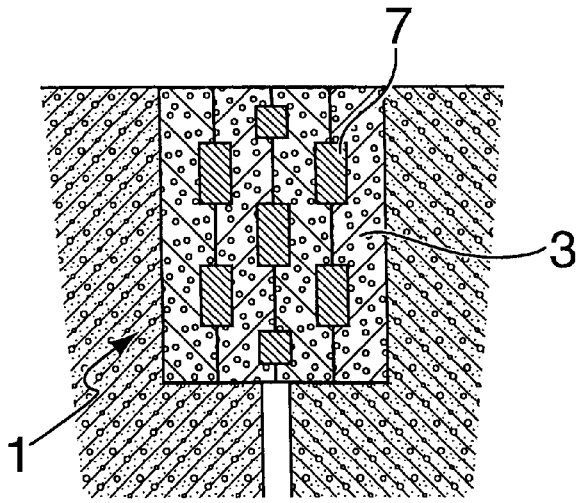

In FIGS. 6 and 8, an alternative to the embodiment shown in FIGS. 1–4 is illustrated. In FIG. 6, two layers of compressible adhesive impregnated foam 3 sandwich one or more strips 7 of hydrophilic material, embedded between the layers of foam. In FIG. 8 four layers of foamed sandwich three layers of strips 7, which are staggered as to expand in a fairly rectangular direction. The function of the hydrophilic layers in this case is to act as a fail-safe, to ensure that if water does manage to penetrate between the layers of foam, as may be the case in extreme conditions, it is absorbed into the hydrophilic material, which when it expands, acts to further tighten the seal of the compressible foam.

It will be understood from the foregoing that the combinations of layers of foam—both compressible and not—and hydrophilic materials can be developed without departing from the present invention.

I claim:

1. A joint seal for use in joints that may be exposed to water comprising:

at least one layer of a compressible impregnated open cell foam, on at least a portion of the surface of which is positioned a hydrophilic material; and at least one layer of incompressible closed cell foam, each said layer of incompressible closed cell foam being adjacent at least one of said hydrophilic material and one said layer of said open cell foam.

2. A joint seal for use in joints that may be exposed to water, comprising:

at least one layer of a compressible impregnated open celled foam having a surface and a hydrophilic material positioned on at least a portion of said surface thereof, said joint seal including at least another layer of compressible impregnated open celled foam, two said layers of said open celled foam sandwiching a layer of said hydrophilic material.

3. A joint seal for use in joints that may be exposed to water, comprising:

least one layer of a compressible impregnated open celled foam having a surface and a hydrophilic material positioned on at least a portion of said surface thereof, said joint seal including at least another layer of a compressible open celled foam, two said layers of said open celled foam having embedded therebetween at least one strip of said hydrophilic material.

4. A joint seal as claimed in claim 1, wherein one said layer of non-compressible closed cell foam is sandwiched by two layers of said hydrophilic material, onto the outer surfaces of which said layers of said hydrophilic material are adhered layers of said open cell foam.

5. A joint seal as claimed in claim 1, wherein said hydrophilic material at least partially impregnates a surface of said open cell foam.

6. A joint seal as claimed in claim 5, including two layers of said open cell foam at least partially impregnated with hydrophilic material, sandwiching one said layer of incompressible closed cell foam.

* * * * *